US005916380A

United States Patent [19]

Yuki et al.

[11] Patent Number: 5,916,380

[45] Date of Patent: Jun. 29, 1999

[54] FE-NI ALLOY FOR PARTS OF ELECTRON-GUN AND BLANKED PARTS FOR ELECTRON-GUN

[75] Inventors: Norio Yuki; Masazumi Mori; Yoshihiro Ozeki, all of Kanagawa, Japan

[73] Assignee: Nippon Mining & Metals Co., Ltd., Tokyo, Japan

[21] Appl. No.: 08/723,989

[22] Filed: Sep. 30, 1996

[30] Foreign Application Priority Data

Sep. 28, 1995 [JP] Japan ..... 7-274737

[51] Int. Cl.[6] ..... C22C 38/08; C22C 19/03

[52] U.S. Cl. ..... 148/336; 148/426; 148/442; 148/581; 420/94; 420/459

[58] Field of Search ..... 420/94, 459, 581; 148/336, 310, 426, 442, 581; 313/402

[56] References Cited

U.S. PATENT DOCUMENTS

| | | | |
|---|---|---|---|
| 4,864,188 | 9/1989 | Sugai et al. | 313/402 |
| 5,391,241 | 2/1995 | Watanabe et al. | 420/94 |
| 5,605,581 | 2/1997 | Inoue et al. | 420/94 |

OTHER PUBLICATIONS

Patent Abstracts of Japan, 6–122945 (A), May 6, 1994, "Electrode Material For Fe–Ni Electron Gun".

Patent Abstracts of Japan, 7–003400 A, Jan. 6, 1995, "Fe–Ni Alloy For Electrode of Electronic Gun".

Patent Abstracts of Japan, 7–034200 A, Feb. 3, 1995, "Fe–Ni Series Alloy Sheet For Lead Frame".

*Primary Examiner*—Deborah Yee
*Attorney, Agent, or Firm*—Kubovcik & Kubovcik

[57] ABSTRACT

An Fe—Ni alloy for use as a part 10 of an electron-gun 4 is press-blanked by a punch to form minute apertures 10a, 10b, 10c for passing an electron beam 3. The burrs 10 formed around the minute apertures 10a, 10b, 10c are detrimental to such part 4. The Fe—Ni alloy according to the present invention essentially consists of from 30 to 55 wt % of Ni, not more than 0.5 wt % of Si, not more than 1.5 wt % of Mn, and the balance being Fe and unavoidable impurities. The alloy includes from 10 to 1,000 of A type or B type non-metallic inclusions of 10 $\mu$m or more in length per 1 $mm^2$ of longitudinal cross section, and from 100 to 50,000 of C type non-metallic inclusions having a diameter of 5 $\mu$m or less.

13 Claims, 3 Drawing Sheets

FE-NI ALLOY FOR PARTS OF ELECTRON-GUN AND BLANKED PARTS FOR ELECTRON-GUN

BACKGROUND OF INVENTION

1. Field of Invention

The present invention relates to an Fe—Ni alloy with improved blanking property, which is suitable for the electrode material of an electron-gun. The present invention also relates to press-blanked parts of an electron gun, which are manufactured by blanking the Fe—Ni alloy and by piercing minute apertures though which an electron beam is passed.

2. Description of Related Art

FIG. 1 is a cross-sectional view of the known shadow-mask type color cathode-ray tube. A fluorescent coating 2 is applied on the panel 1 and emits three primary colors, i.e., red, green and blue. An electron gun 4 is provided in the neck of the cathode-ray tube and emits electron beams 3. The electron beams 3 are deflected and scanned by the deflecting yoke 5. Reference numerals 6 and 7 denote the shadow mask and the magnetic shield, respectively. All of these parts 1 through 7 are known.

FIG. 2 illustrates a rolled and then press-blanked part 10, which is an electrode of the electron gun 4. Reference numerals 10*r*, 10*r* ′ denote the major rolled surfaces. FIGS. 2 (A) and (B) are the illustrative view and cross-sectional view of an electrode, respectively. The minute apertures 10*a*, 10*b* and 10*c* are formed by coining and blanking a sheet and allow the respective electron beam to pass therethrough for generating the colors red (10*a*), green (10*b*) and blue (10*c*). For the parts of an electron-gun used in an image-receiving tube, a non-magnetic stainless steel sheet having a thickness of from 0.05 to 0.5 mm has conventionally been used, since the non-magnetic property is important for the electrodes 10 which accelerate the thermal electrons emitted from the cathode of the electron gun. Such a sheet is intermediately coined and then blank-worked as above or directly blanked without coining.

Recently, rather than the non-magnetic property, a low thermal expansion property is considered to be more important, because the image-receiving tube of a computer-display or the like has become highly precise and its performance is enhanced. In this case, picture performance (purity of color) is influenced by subtle dimensional changes in the electrode 10 due to its thermal expansion.

Since an Fe—Ni alloy, particularly Fe-42% Ni alloy (the so-called 42 Alloy), has a low thermal expansion property, its use for the electrode material has now been undertaken. However, when the conventional 42 Alloy is blanked by means of a punch to form the electrode part, burrs are detrimentally formed at the front end 10*e* (FIG. 3), where the blanking tailings are separated from the sheet. The blanking burrs exert a detrimental effect upon the dimensional accuracy of the electron-gun part which is required to be highly precise. In addition, since an abnormal discharge occurs at the burr, when a high voltage is applied to the electrode, the voltage-resistance of an electron-gun is lowered. This is a very serious disadvantage. Lessening of the burrs of an electrode-gun part will be more and more highly demanded along with precision of an image-receiving tube.

There are, heretofore, proposals in Japanese Unexamined Patent Publications Nos. 6-122,945, 6-184,703, 7-84,199, 7-3,400 and 7-34,200 to improve the blanking property of an Fe—Ni alloy. In Japanese Unexamined Patent Publication No. 6-184,703, the S content of an Fe—Ni alloy is limited to a range of from 0.002 to 0.05%, and the sulfur or sulfur compound is dispersed along the grain boundaries or within the crystal grains. However, the burrs cannot be satisfactorily prevented only by means of adding a specified amount of sulfur and hence efforts to improve the machinability, when the alloy is subjected to the extremely precise press forming, have been carried out in recent years.

Next, the proposals made in Japanese Unexamined Patent Publications Nos. 6-122,945, 7-84,199, and 7-34,200, reside in that such strengthening elements as Ti, Nb, V, Ta, W, Zr and the like are added to enhance the hardness and hence to induce a degree of brittleness thereby suppressing the burrs. The life of a metal die is, however, shortened due to the increased hardness of the Fe—Ni alloy, and the cost of the alloy must increase due to addition of special elements.

Japanese Unexamined Patent Publication No. 7-34,200 discloses a lead-frame made of an Fe—Ni alloy, and proposes to specify the morphology and the number of non-metallic inclusions, of which the length is 1 $\mu$m or more measured in the direction parallel to the rolling direction. That is, the number of non-metallic inclusions in a cross section of 10 $mm^2$ parallel to the rolling direction is limited. As a result of such specification and limitation of the inclusions, it is allegedly possible to increase the number of pins of a lead-frame. As is described in this patent publication, it is necessary to specify the maximum length of non-metallic inclusions depending upon the shape, dimension and the like of the lead-frame to be produced. This description suggests that there is a relationship between the appropriate morphology of non-metallic inclusions and a particular part of an electronic device. More specifically, it is understood that the morphology of non-metallic inclusions appropriate for a part of an electron-gun must be different from that appropriate for a lead frame, because shapes and dimensions of the parts are different. However, such relationship has heretofore not been clarified.

SUMMARY OF THE INVENTION

It is an object of the present invention to eliminate the above described drawbacks and to provide an Fe—Ni alloy, of which blanking property required for the press-formed part of an electron gun is improved.

It is another object of the present invention to provide a press-blanked part of an Fe—Ni alloy used in an electron gun, and hence to suppress the burrs formed on the press-blanked part.

In accordance with the present invention, there is provided an Fe—Ni alloy, which essentially consists of by weight percentage, from 30 to 55% of Ni, not more than 0.5% of Si, not more than 1.5% of Mn, and the balance being Fe and unavoidable impurities, and which includes from 10 to 1,000 of A type or B type non-metallic inclusions having a length 10 $\mu$m or more, per 1 $mm^2$ or more of the cross section parallel to the rolling direction and parallel to a direction across the rolling surfaces, and from 100 to 50,000 of C type non-metallic inclusions having a diameter of 5 $\mu$m or less.

In accordance with the present invention, there is also provided a press-blanked Fe—Ni alloy rolled-sheet, which essentially consists of, by weight percentage, from 30 to 55% of Ni, not more than 0.5% of Si, not more than 1.5% of Mn, and the balance being Fe and unavoidable impurities, and which includes from 10 to 1,000 of A type or B type non-metallic inclusions having a length of 10 $\mu$m or more, per 1 $mm^2$ of the cross section parallel to the rolling direction and parallel to a direction across the rolling surfaces, and from 100 to 50,000 of C type non-metallic inclusions having a diameter of 5 $\mu$m or less.

DESCRIPTION OF PREFERRED EMBODIMENTS

The present invention is hereinafter described in detail.

Ni is an important element in the Fe—Ni alloy and determines the thermal expansion property. When the Ni content is less than 30% or more than 55%, the coefficient of thermal expansion becomes disadvantageously high. The Ni content is therefore from 30 to 55%.

Si has mainly a deoxidizing function and is present in the Fe—Ni alloy in a small amount as the A, B and/or C type nonmetallic inclusions. The solute Si hardens the Fe—Ni alloy and hence improves the blanking property. Preferably, Si is therefore contained in a small amount. However, when the Si content is more than 0.5%, the Fe—Ni alloy is excessively hardened and the long life of the metal die can not be ensured. A preferred Si content is from 0.1 to 0.5%.

Mn is added usually for the purpose of deoxidizing and improving the hot-workability. As a result of Mn addition, MnO-based inclusions (B or C type non-metallic inclusions) and MnS-based inclusions (A type non-metallic inclusions) are formed. Mn hardens the Fe—Ni alloy as Si does and improves the press blanking property. However, when the Mn content is more than 1.5%, the Fe—Ni alloy is excessively hardened and the long life of the metal die can not be ensured. A preferred Mn content is from 0.1 to 1.5%.

The elements other than the ones above mentioned are Fe and unavoidable impurities which include ordinary elements such as carbon, oxygen, phosphorus, sulfur, aluminum, copper and the like. These impurities in an elemental form are detrimental to the press-blanking property and the thermal expansion property. These elements are also present in the form of fine non-metallic inclusions, such as $Al_2O_3$, MnS, $SiO_2$, $P_2O_5$ and $Cu_2S$ and improve the press-blanking property. The total content of the impurities is preferably from approximately 100 to 2,000 ppm.

According to one of the most characterizing features of the present invention, the amount of non-metallic inclusions is specified in relation to the respective morphology types, as follows. The number of A type or B type non-metallic inclusions should be from 10 to 1,000 per 1 $mm^2$ of longitudinal cross section of a sheet. From 100 to 50,000 of the C type non-metallic inclusions having a diameter of 5 $\mu$m or less must be present per 1 $mm^2$ of the above mentioned cross section. The diameter herein is that of a circle having the same area as the respective non-metallic inclusion particle. The length of the B type non-metallic inclusions is that of a group or cluster of such inclusions arranged in a linear form, which is distinctly separated from other groups or clusters. When the A or B type non-metallic inclusions have a length less than 10 $\mu$m, these inclusions have only a negligible crack-initiating effect during blanking. Therefore, in the present invention, the number of the A or B type non-metallic inclusions only of 10 $\mu$m or longer is specified. When the number of such A or B type non-metallic inclusions is less than ten per 1 $mm^2$ of the longitudinal cross section, the inclusion density and hence the number of the fracture-initiating points are so small that cracking is not generated smoothy in the vicinity of the front edge of a blanking punch. In this case, very large burrs are formed around the blanking aperture. On the other hand, when such inclusion density is more than 1,000 per 1 $mm^2$ of the cross section, the blanked surface becomes so rough that an abnormal electric discharge occurs on the roughened surface, like a discharge on the burrs. The number of the A or B type non-metallic inclusions 10 $\mu$m or longer is, therefore, from 10 to 1,000, preferably from 50 to 800 per 1 $mm^2$ of the cross section.

Next, the C type non-metallic inclusions 5 $\mu$m or more in diameter are also effective for propagating the cracks but disadvantageously bring about powdering during the press-blanking, thus shortening the life of the metal die. The number of C-type non-metallic inclusions 5 $\mu$m or smaller is therefore specified in the present invention. Voids form near the 5 $\mu$m or smaller C-type non-metallic inclusions, when the Fe—Ni alloy is subjected to shear stress from a blanking punch. The C-type non-metallic inclusions larger than 5 $\mu$m are desirably absent. Note, however, C-type non-metallic inclusions larger than 5 $\mu$m do not impede the attaining of the objects of the present invention, particularly in suppressing the burrs, at only bring about powdering and the like, mentioned above. When the number of C type non-metallic inclusions is less than 100 per 1 $mm^2$ of the cross section, its number is too small to quickly propagate such cracks via the voids, when such cracks have generated at the crack-initiation points where the A or B type non-metallic inclusions are present. When such number is more than 50,000, the blanked surface is so roughened that it is unsuitable for the parts of an electron-gun.

Observation of the non-metallic inclusions described above should be carried out as follows. A longitudinal cross section is subsequently etched by a 2% Nital solution for a few seconds. The polishing and etching should be carefully carried out so as not to make the observation of minute inclusions, particularly the C type non-metallic inclusions having a size of submicrons, difficult. The so-prepared sample is subjected to observation by an optical microscope, an electron-microscope or the like. Evidently, the size of the non-metallic inclusions of an etched sample is not the actual one, strictly speaking. However, the margin of measurement error is definitely lower than the specified limits, that is, 10 $\mu$m for the A or B type and 5 $\mu$m for the C type.

The amount of the non-metallic inclusions as described above can be controlled as follows.

Iron sources, such as iron scraps for the electro-magnetic material and electrolytic nickel are prepared as the main starting materials. The amount of non-metallic inclusions contained in the starting materials is preliminarily measured. When the measured amount of non-metallic inclusions is small, a small amount of oxygen and sulfur is added to the main starting materials. The oxygen may be in the form of iron oxide, while the sulfur may be in the form of nickel sulfide or iron sulfide. The oxide and sulfides may be added in the order of 100 grams per 100 kg of the main starting materials. The oxygen and sulfur contained in the additive materials cause reaction with the deoxidizing agent during melting or reaction with refractory material of a ladle and the like, resulting in formation of non-metallic inclusions. Melting of the starting materials is carried out by high-frequency vacuum melting where the oxidation by air is slight. The vacuum degree may, however, be lessened to promote the oxidation during melting.

When the amount of non-metallic inclusions is very large in the main starting materials, these are mixed with another material having a high purity, and the mixed materials should be melted in vacuum.

The A, B and C type non-metallic inclusions are as stipulated in JIS G 0555 (Method for Microscopic Testing Method of Nonmetallic Inclusions in Steel). The A and B type non-metallic inclusions are the so-called linear inclusions.

(1) A type Inclusion: Inclusions formed by viscous deformation during working (sulphides, silicates, etc.). If necessary, they are classified further into sulfides and silicates, and the former shall be called $A_1$ type inclusion and the latter $A_2$ type inclusion.

(2) B type inclusion: Inclusions formed by granular inclusions discontinuously and collectively disposed in the working direction (alumina, etc.).

As for the steel containing Nb, Ti and Zr (only one, or more than two thereof), if necessary, inclusions are further classified into oxide such as alumina and carbo-nitride of Nb, Ti, and Zr, and the former shall be called $B_1$ type inclusion and the latter $B_2$ type inclusion.

(3) C type Inclusion: Inclusions formed by irregular dispersion without viscous deformation (granular oxide, etc.).

As for the steel containing Nb, Ti, and Zr (only one, or more than two thereof), if necessary, inclusions are further classified into oxide and carbo-nitride of Nb, Ti, and Zr, and the former shall be called $C_1$ type inclusion and the latter $C_2$ type inclusion. The present inventors made detailed investigation on the influence of the non-metallic inclusions on the press-blanking property of an Fe—Ni alloy for use as the parts of an electron gun. It has then been elucidated that the linear inclusions and the C type inclusions have different roles from one another, in the fracture mechanism by the blanking. The former and latter inclusions should, therefore, be specified from the different points of view and in different ranges. More specifically, the press blanking induces shear deformation in the workpiece. As the shear deformation proceeds, the stress in the vicinity of the tool edge increases so that the fracture finally starts. This fracture starts at the initiation points where the A or B type non-metallic inclusions, which are rather coarse, are present. Cracks spread, therefore, from the A or B type non-metallic inclusions. At the front end of the cracks the stress is further enhanced due to stress concentration. The C type non-metallic inclusions, which are rather fine, become a site of the void-formation. The once generated cracks propagate via the voids and finally cause fracture across the workpiece.

The present invention is hereinafter described by way of an example with reference to drawings.

EXAMPLE

Example

Figure 1:
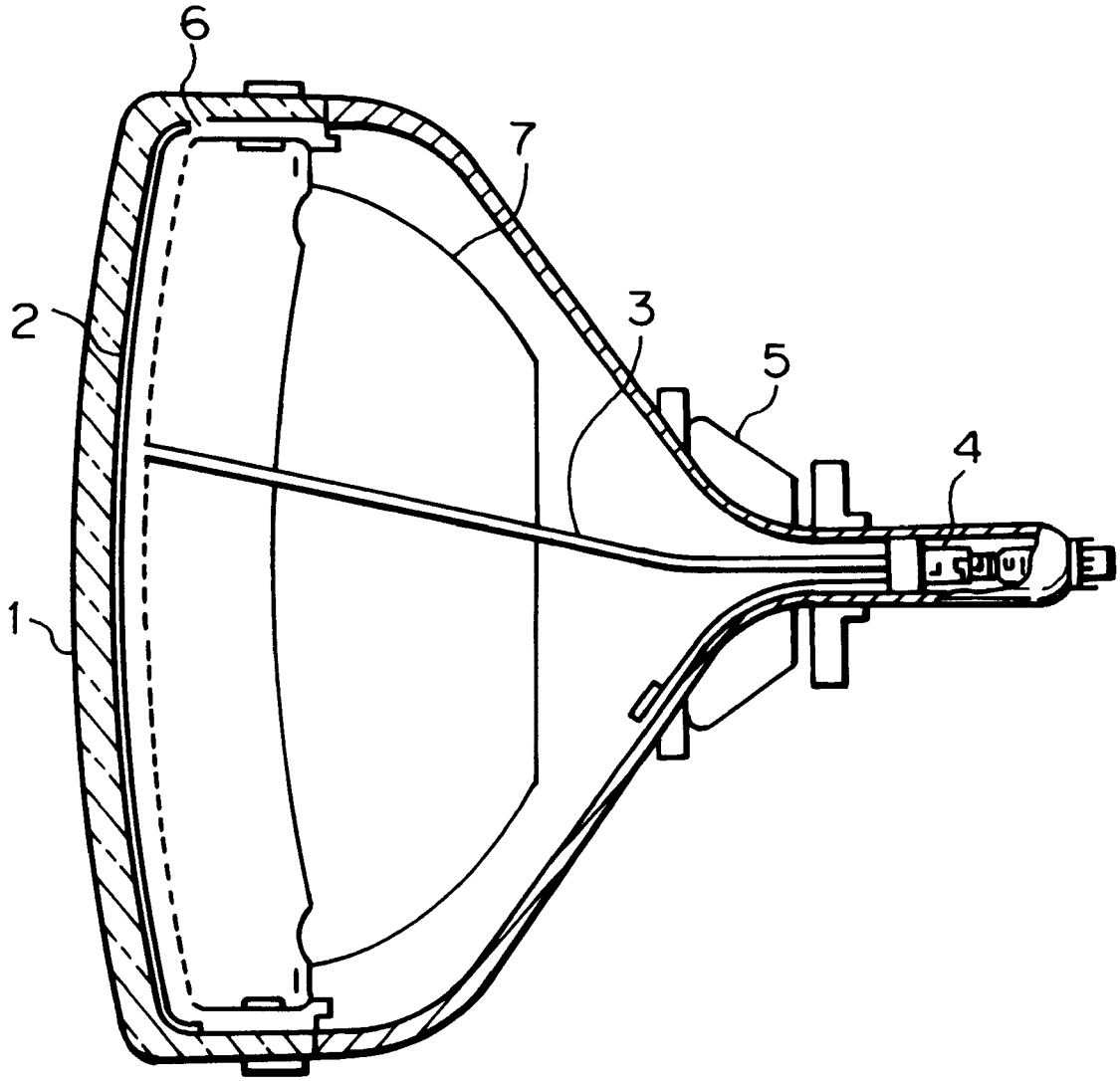
Fig. 1 PRIOR ART
FIG. 1 is a cross sectional view of a known, shadow mask type cathode-ray tube.

An Fe-42 wt % Ni alloy was melted in an induction-type vacuum melting furnace under the vacuum degree of $10^{-5}$ Torr to $10^{-1}$ Torr. The starting materials were electrolytic iron of high-purity grade, scraps of press-formed steel sheets, resulfurized carbon steel, rimmed-steel scraps, electrolytic nickel, and electrolytic manganese. The starting materials were mixed to provide the main components, i.e., 42 wt % of Ni and the balance of Fe and to adjust the contents of impurities such as S, Al and O. Ingots each approximately 6 kg in weight were manufactured.

The ingots were homogenization annealed and then hot-rolled at 1200° C. to obtain 4 mm thick plates. The plates were annealed and pickled. Cold-rolling was then carried out to obtain 1.5 mm thick sheets. After bright annealing, the cold-rolling was carried out to obtain 0.4 mm thick sheets. The 0.4 mm thick sheets were annealed at 750° C. for 1 hour in vacuum. The resultant sheets were subjected to tests.

Figure 2A:
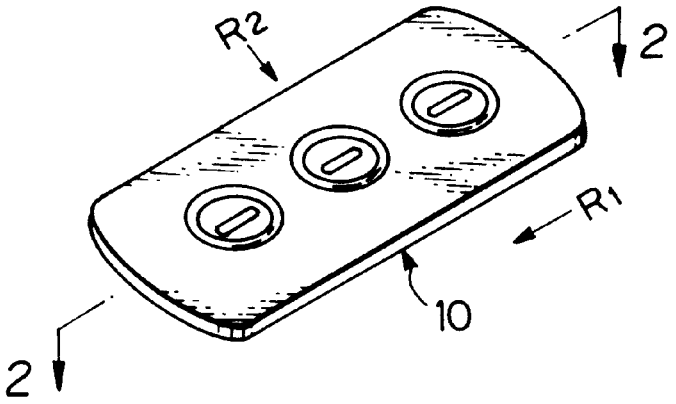
Fig. 2(A) PRIOR ART
FIG. 2(A) is an elevational view of an electrode of the cathode-ray tube shown in FIG. 1. The electrode shown is an example of the blanked parts of an electron-gun, according to the present invention.
Figure 2B:
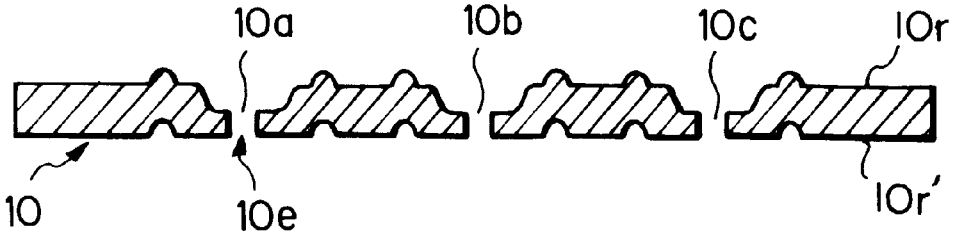
FIG. 2(B) is a cross sectional view along 2—2 of FIG. 2(A).
Figure 3:
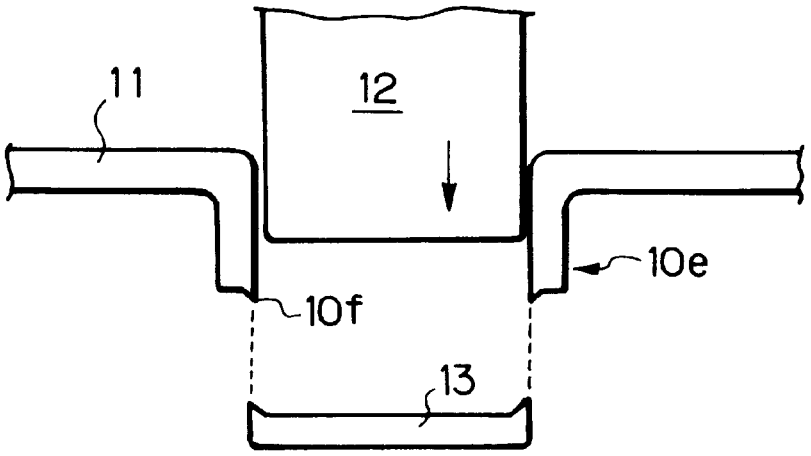
FIG. 3 illustrates a blanking method.
Figure 4A:
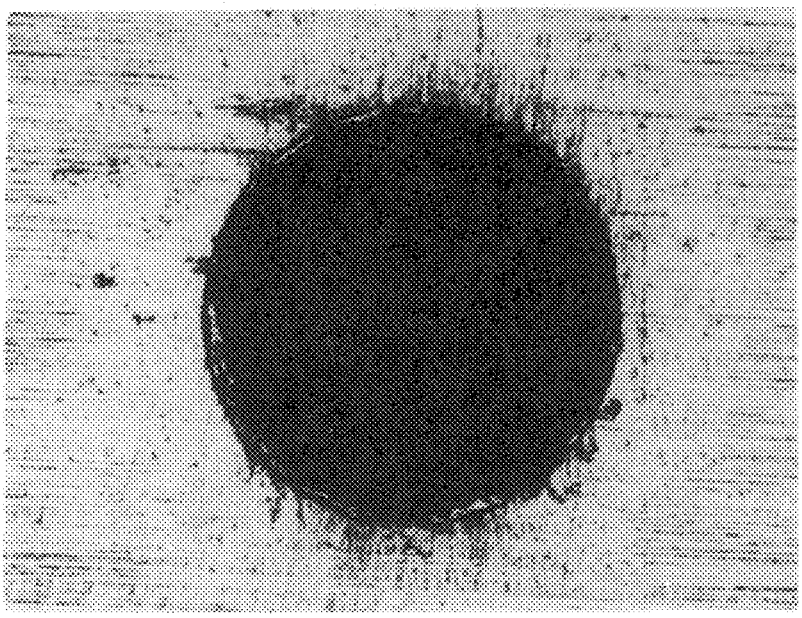
FIG. 4(A) is a photograph (magnification of 100) of the blanked aperture through a sample of the inventive example, showing the shape of burrs.
Figure 4B:
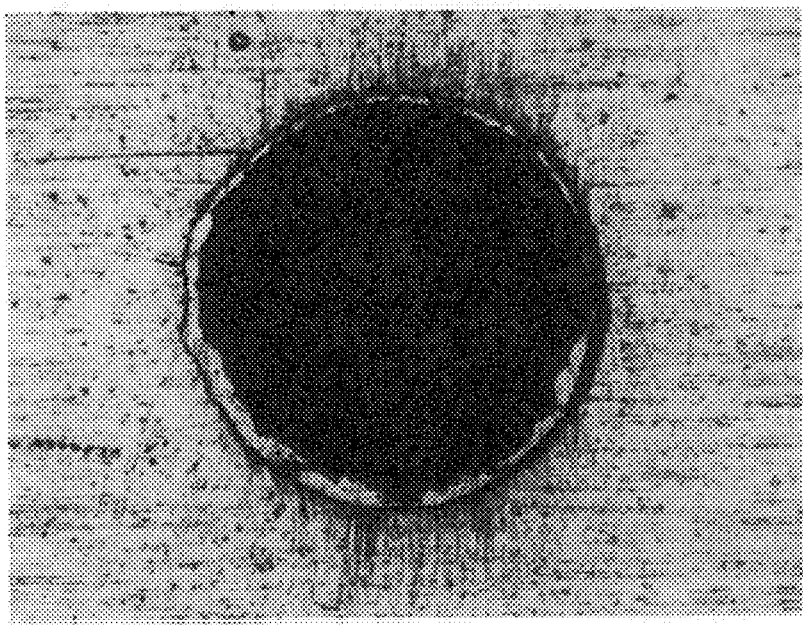
FIG. 4(B) is a photograph (magnification of 100) of the blanked aperture through a sample of the comparative example, showing the shape of burrs.

The blanking property was evaluated in the press-forming using a 30-ton press machine which pierced ten apertures 0.4 mm in diameter at intervals of 3 mm. The maximum thickness and height of the burrs formed then were measured. In addition, the fracture surface ratio was also measured. The fracture surface ratio is defined by (thickness of fractured cross section/sheet thickness)×100 (%). The burrs are shown in FIGS. 2(A) and (B). Thickness of the burrs are the size of burrs as shown in FIGS. 2(A) and (B), that is, their protruding length from the outer periphery from the aperture.

In Table 1 is shown the chemical compositions of the inventive alloys and comparative alloys, the maximum thickness and height of the burrs and the rupture surface ratio.

TABLE 1

| | Chemical Composition (wt %) | | | Number of Inclusions (per mm²) | | Burrs | | Fractured Surface | |
|---|---|---|---|---|---|---|---|---|---|
| | | | | A or B type | C type | Max. Thickness | Max. Height | Ratio | Roughening |
| No. | Ni | Si | Mn | 10 μm or less | 5 μm or less | (μm) | (μm) | (%) | Condition |
| 1 | 41.2 | 0.05 | 0.45 | 47 | 782 | 20 | 7 | 21.3 | good |
| 2 | 40.9 | 0.12 | 0.46 | 76 | 1211 | 18 | 5 | 22.7 | good |
| 3 | 41.8 | 0.25 | 0.52 | 35 | 561 | 21 | 5 | 21.5 | good |
| 4 | 41.0 | 0.29 | 0.50 | 134 | 2875 | 15 | 4 | 23.1 | good |
| 5 | 41.5 | 0.17 | 0.48 | 112 | 2244 | 17 | 7 | 23.8 | good |
| 6 | 40.8 | 0.02 | 0.61 | 8 | 86 | 51 | 16 | 12.4 | good |
| 7 | 41.8 | 0.09 | 0.56 | 5 | 74 | 45 | 13 | 13.8 | good |
| 8 | 41.3 | 0.18 | 0.47 | 7 | 91 | 58 | 15 | 11.9 | good |
| 9 | 42.1 | 0.16 | 0.51 | 1105 | 46254 | 12 | 3 | 25.7 | poor |
| 10 | 40.4 | 0.21 | 0.56 | 847 | 59214 | 13 | 3 | 24.4 | poor |

Remarks. The balance of the Ni, Si and Mn composition is Fe except for a trace of impurities. Nos. 1 through 5 are the inventive examples, while Nos. 6 through 10 are the comparative examples.

As is apparent from Table 1 and FIGS. 2(A) and (B), the maximum thickness and height of the burrs of the inventive examples are less as compared with the comparative examples. The burrs are therefore considerably suppressed by the present invention during the press blanking. The fracture surface ratio of the inventive examples is greater than that of the comparative examples. The press-blanking property is, therefore, improved by the present invention.

We claim:

1. An Fe—Ni alloy in the form of a rolled sheet having major rolled surfaces, which alloy essentially consists of from 30 to 55% of Ni, not more than 0.5% of Si, not more than 1.5% of Mn, and the balance being Fe and unavoidable impurities, and which includes from 10 to 1,000 of A type or B type non-metallic inclusions of 10 μm or more in length per 1 $mm^2$ of longitudinal cross section, and from 100 to 50,000 of C type non-metallic inclusions of 5 $\mu$m or less in diameter.

2. An Fe—Ni alloy according to claim 1, wherein the Si content is from 0.1 to 0.5%.

3. An Fe—Ni alloy according to claim 1 or 2, wherein the Mn content is from 0.1 to 1.5%.

4. An Fe—Ni alloy according to claim 1 or 2, wherein the content of impurities is from 100 to 2,000 ppm.

5. An Fe—Ni alloy according to claim 4, wherein the impurities are at least one element selected from the group consisting of C, O, P, S, Al and Cu.

6. An Fe—Ni alloy according to claim 5, wherein the number of the A or B type non-metallic inclusions is from 50 to 800 per 10 $mm^2$ of the cross section.

7. A press-blanked part of an electron-gun, said part consisting of a press-blanked part of the Fe—Ni alloy according to claim 1 or 2.

8. A press-blanked part of an electron -gun, said part consisting of a press-blanked part of the Fe—Ni alloy according to claim 3.

9. A press-blanked part of an electron -gun, said part consisting of a press-blanked part of the Fe—Ni alloy according to claim 4.

10. A press-blanked part of an electron -gun, said part consisting of a press-blanked part of the Fe—Ni alloy according to claim 5.

11. A press-blanked part of an electron -gun, said part consisting of a press-blanked part of the Fe—Ni alloy according to claim 6.

12. A press-blanked part of an electron -gun, said part consisting of a press-blanked part of the Fe—Ni alloy according to claim 7, which part is an electrode of the electron-gun.

13. A press-blanked part of an electron-gun according to claim 12, wherein said part includes press-blanked apertures for passing electron beam.

* * * * *